US006984274B2

(12) United States Patent
Hofmann et al.

(10) Patent No.: US 6,984,274 B2
(45) Date of Patent: Jan. 10, 2006

(54) EXPLOSIVE COMPOSITION AND ITS USE

(75) Inventors: Achim Hofmann, Polling (DE); Horst Laucht, Bruckmühl (DE); Dimitri Kovalev, Garching (DE); Victor Yu Timoshenko, Moscow (RU); Joachim Diener, Erooldsbach (DE); Nicolai Künzner, München (DE); Egon Gross, Taufkirchen (DE)

(73) Assignee: TRW Airbag Systems GmbH, Aschau am Inn (DE)

( * ) Notice: Subject to any disclaimer, the term of this patent is extended or adjusted under 35 U.S.C. 154(b) by 0 days.

(21) Appl. No.: 10/360,495

(22) Filed: Feb. 6, 2003

(65) Prior Publication Data

US 2005/0072502 A1 Apr. 7, 2005

(30) Foreign Application Priority Data

Feb. 6, 2002 (DE) ..... 102 04 834

(51) Int. Cl.
*C06B 45/00* (2006.01)
*D03D 23/00* (2006.01)

(52) U.S. Cl. ..... 149/2; 149/14; 149/109.6

(58) Field of Classification Search ..... 149/2, 149/3, 5, 6, 14, 15, 17, 109.6
See application file for complete search history.

(56) References Cited

U.S. PATENT DOCUMENTS

2003/0183109 A1 * 10/2003 Rudhard et al. ..... 102/200

FOREIGN PATENT DOCUMENTS

| | | | |
|---|---|---|---|
| DE | 1188981 | | 7/1966 |
| DE | 3105060 | C1 | 9/1982 |
| DE | 69423631 | T2 | 6/1996 |
| DE | 10162413 | A1 | 7/2003 |
| EP | 0763511 | A2 | 3/1997 |
| WO | WP 99/12870 | | 3/1999 |
| WO | WO 01/38264 | | 5/2001 |
| WO | WO 01/94276 | | 12/2001 |

OTHER PUBLICATIONS

Article entitled "Advanced Materials", 2002, 14, No. 1, pp. 38-41.
University of California, San Diego: External Relations: News & Information: New Releases, 9. Jan. 2002, pp. 1-2.
Physical Review Letters, vol. 87, Nr. 6, pp. 068301-1 to 068301-4.
Article entitled "On the Morphology and the Electrochemical Formation Mechanism of Mesoporous Silicon", pp. 11-22.

* cited by examiner

*Primary Examiner*—Aileen Felton
(74) *Attorney, Agent, or Firm*—Tarolli, Sundheim, Covell & Tummino L.L.P.

(57) ABSTRACT

An explosive composition comprises a porous fuel and an oxidizer. The porous fuel is a solid with a structure size measuring between about 2 nm and 1000 nm and has a porosity that lies between 10% and 98%. The oxidizer is solid or liquid at room temperature and is incorporated into the pores of the porous fuel. The oxidizer is selected, in an amount of at least 50% by weight relative to a total quantity of the oxidizer, from the group consisting of hydrogen peroxide, hydroxyl ammonium nitrate, organic nitro compounds or nitrates, alkali metal nitrates or earth alkali metal nitrates as well as metal nitrites, metal chlorates, metal perchlorates, metal bromates, metal iodates, metal oxides, metal peroxides, ammonium perchlorate, ammonium nitrate and mixtures thereof.

23 Claims, No Drawings

EXPLOSIVE COMPOSITION AND ITS USE

TECHNICAL FIELD

The invention relates to an explosive composition comprising a porous fuel and an oxidizer.

BACKGROUND OF THE INVENTION

Explosive materials always consist of a fuel and an oxidizing agent that have to be present simultaneously. The fuels known so far usually contain carbon and hydrogen, while substances containing oxygen as well as fluorine or chlorine are used as the oxidizing agents. Civilian applications require that the reaction products released during the explosion must be environmentally safe and non-toxic. Hence, the use of substances containing oxygen as the oxidizing agent is preferred.

Known explosive materials that are based on this principle include, for example, black powder, a mixture of potassium nitrate, sulfur and carbon, or else organic explosives such as trinitrotoluene (TNT).

All of these compositions or compounds, however, have drawbacks that limit their usefulness. Thus, for instance, the stoichiometry of one-component chemical compounds is defined by their chemical formula. As a rule, however, these compounds do not contain sufficient oxygen to ensure the total combustion of the carbon and hydrogen. This leads, among other things, to toxic reaction products such as, for example, carbon monoxide. Moreover, a critical mass of the chemical compound is needed in order to bring about an explosive reaction. Lastly, one-component systems cannot be adjusted in terms of their pyrotechnical properties, so that the addition of adjuvants and moderators is necessary.

In contrast, the pyrotechnical effect of explosive compositions consisting of several components depends on physical quantities such as, for instance, the particle size, the mixing ratio and the homogeneity of the components. Furthermore, after being manufactured by means of granulation, compression, extrusion or casting, all of these compositions have to be rendered into a manageable form. Moreover, these compositions often exhibit low structural strength.

It is known from Physical Review Letters 87/6 (2001), pp. 068301/1 to 068301/4 that a spontaneous explosion occurs when liquid oxygen is brought together with porous silicon that has been made by electrochemically etching silicon in an electrolyte containing hydrogen fluoride.

Adv. Mater., 2002, 14, No. 1, pp. 38 to 41 reports that a freshly made, porous silicon mixed with gadolinium nitrate ($Gd(NO_3)_3.6H_2O$) can be made to explode through friction with a diamond tip or by an electrical spark discharge. The porous silicon mixed with gadolinium nitrate is used here as the source of energy for atom emission spectroscopy.

Thus, the invention is based on the objective of providing a stable explosive composition which can be manufactured inexpensively and can be used in particular for civilian applications and which can be integrated, if desired, in known components.

BRIEF SUMMARY OF THE INVENTION

According to the invention, an explosive composition comprises a porous fuel and an oxidizer. The porous fuel is a solid with a structure size measuring between about 2 nm and 1000 nm and has a porosity that lies between 10% and 98%. The oxidizer is solid or liquid at room temperature and is incorporated into the pores of the porous fuel. The oxidizer is selected, in an amount of at least 50% by weight relative to a total quantity of the oxidizer, from the group consisting of hydrogen peroxide, hydroxyl ammonium nitrate, organic nitro compounds or nitrates, alkali metal nitrates or earth alkali metal nitrates as well as metal nitrites, metal chlorates, metal perchlorates, metal bromates, metal iodates, metal oxides, metal peroxides, ammonium perchlorate, ammonium nitrate and mixtures thereof.

The explosive composition according to the invention allows the pyrotechnical properties to be adjusted over a wide range. Thus, for example, the amount of the oxidizer incorporated into the porous fuel can be defined via the porosity of the fuel, that is to say, the ratio of the pore volume to the volume of the specimen; with this, the energy density and the energy discharge rate of the composition can be controlled. The porosity can be determined, for example, by electron-microscopic images, gravimetrically or by means of TEM. Preferably, the porosity is between about 40% and 80%. In case the composition is used in this range for employment in an igniter, the optimum energy density and the optimum energy discharge rate will be ensured.

Providing the porous fuel as a solid, preferably in the form of a structurally stable shaped body in which the fuel is present as a rigid structural matrix, makes it possible in an advantageous way to use the composition as a constructional element in pyrotechnical devices, as a semiconductor component or as a micromechanical component.

The structure size or the size and shape of the pores, respectively, can likewise be varied over a wide range. The structure size indicates the average size of the nanocrystals of which the fuel consists, and lies preferably within the range from 2 nm to 50 nm, particularly preferably between 2 nm and 10 nm. The pore size preferably lies in the range between 2 nm and 1000 nm. Mesoporous structures having pore diameters and a structure size of between 2 nm and 500 nm, especially between 2 nm and 200 nm, respectively, however are particularly preferred. On the one hand, the mesoporous structures have a sufficient reactiveness, and on the other hand they can be easily adjusted in terms of their pyrotechnical properties.

The small structure size of the porous fuel leads to a high specific surface area, which is preferably between 200 and 1000 $m^2/cm^3$. Thus, an optimal contact between fuel and oxidizer is ensured.

The porous fuel is preferably selected from the group consisting of Si, Ge, SiGe, SiC, InP, GaAs, C, Be, Mg, Al, Ti and metal hydrides; the semiconductive materials of this group are preferred for a possible integration into known components. The production of nanostructured porous materials from these substances is described in the scientific literature. Suitable production processes are especially chemical or physical deposition processes such as electrochemical deposition, CVD, PVD or sputtering.

It is particularly preferred that the fuel is porous silicon. The use of porous silicon allows integration into known semi-conductor components. Moreover, the electrochemical etching of silicon in solutions containing fluoride is a relatively simple and inexpensive process for the production of the porous silicon.

The porosity and the structure size of the porous silicon can be adjusted in a known manner by selecting suitable etching parameters. Thus, for example, WO-A-96/396990 discloses that the porosity of porous silicon can be influenced by the fluoride concentration in the electrolyte and by the anodizing current (current density). Additional parameters are the pH value of the electrolyte and the treatment duration as well as, optionally, exposure of the silicon to light during the etching. The structure size can also be influenced by the selection of the starting material (p-doped or n-doped Si, highly or slightly doped).

Finally, the etching parameters can also incorporate an anisotropic porosity into the fuel. This means that the porosity is structured three-dimensionally and thus has a defined structure for achieving a directional effect of the combustion or for controlling the combustion rate. In particular, webs or walls can be created in the porous fuel in this manner.

In an advantageous way, the porous fuel is at least partially passivated, that is to say, the inner surface of the fuel is at least partially saturated with oxygen or modified in another way so as to increase the activation energy that has to be overcome so that there can be a reaction with the oxidizer. The passivation can take place, for example, by heating the fuel in an atmosphere containing oxygen or in air as will be described below. The passivation creates additional possibilities for adjusting the pyrotechnical properties of the composition according to the invention, such as, for example, its ignitability through electric discharge or exposure to UV light.

As is known from the prior art, freshly produced porous silicon that has been mixed with liquid oxygen or gadolinium nitrate explodes spontaneously or with minimal extraneous influence through scratching with a diamond cutter. This reaction is problematic from a safety point of view. Moreover, accidental explosions have to be ruled out in order for a pyrotechnical charge to be approved. Also with an eye towards subsequent processing of the porous silicon wafers (e.g. crushing of the wafer into individual components or encapsulating the elements in housings), such spontaneous ignition behavior is undesired in actual practice.

Since the chemical reaction of the porous fuel starts at the surface, a less reactive protective layer on the surface of the nanocrystals can be used to increase the activation energy needed to ignite the fuel. This passivation layer can be applied subsequently onto the porous fuel and can consist of an inert material (for example, Teflon). The passivation layer can also be established by thermal, chemical or electrochemical treatment of the fuel.

In the case of porous silicon, the surface of the silicon nanocrystals immediately after the etching consists predominantly of silicon-hydrogen bonds (Si—H, Si—$H_2$, Si—$H_3$). The fuel/oxidizer reaction sets in when an Si—H bond is broken and silicon reacts with oxygen to form Si—O or Si—$O_2$ while releasing energy. The low activation energy of this process is based on the low bonding strength of the Si—H bond, which can therefore be easily broken.

A stable passivation layer can be formed, for example, by tempering the porous silicon layer in air (following the electrochemical etching and before the oxidizer is filled in). Various degrees of passivation can be selected, depending on the temperatures or on the duration of the tempering step. If the tempering is carried out in the range between 150° C. and 300° C. [302° F. and 572° F.], preferably at about 200° C. [392° F.], after about up to 1600 minutes, an oxygen submonolayer of silicon-oxygen bonds (Si—O) forms which have a higher bonding energy than the silicon-hydrogen bonds. After the tempering, the surface of the silicon nanocrystals consists of H—Si—O complexes since, at about 200° C. [392° F.], the hydrogen on the surface of the nanocrystals is retained and oxygen is bonded to silicon under the first monolayer. (Measurement with FTIR; see, e.g.: "The oxidation behavior of silicon nanocrystals in the submonolayer region"; J. Diener, M. Ben-Chorin, D. Kovalev, G. Polisski, F. Koch; Materials and Devices for Silicon-Based Optoelectronics, Symposium. Mater. Res. Soc.; Warrendale, Pa., USA, 1998, pp. 261 to 266).

In order to initiate a reaction of the fuel with the oxidizer, this Si—O layer has to be broken up. In order for an Si—O bond in this submonolayer region to break, several Si—H bonds on the surface have to be broken up. This increases the activation energy that is needed. Such specimens that have been tempered and, for example, filled with potassium nitrate can be scratched with a diamond cutter and broken without exploding. They are also virtually shockproof. However, the explosion can be triggered by sudden heating, electric discharge or exposure to UV light.

The passivation of the surface of the porous fuel also increases the long-term stability of the explosive composition, since a change to the surface properties of the fuel can no longer occur under the influence of the oxidizer.

If the tempering is carried out at temperatures above about 300° C. [572° F.] (for example, 700° C. [1292° F.], 30 seconds), the hydrogen is driven off of the surface of the nanocrystals and layers of "pure" Si—O bonds are formed. In order to initiate a reaction of the fuel with the oxidizer, this Si—O passivation layer has to be broken up. Since there are no Si—H bonds present any longer, which would facilitate this, the activation energy increases once again. Moreover, the Si—O layer thickness can be adjusted by means of the tempering time, since the layer thickness increases as the tempering time rises. Such tempered and potassium nitrate-filled specimens are extremely stable and safe to handle, even though they can be made to explode by means of sudden heating.

Another advantage of such a passivation layer with complete oxygen covering is the effect as a diffusion barrier vis-à-vis the oxygen excess in the pores since, in addition to fuel/oxidizer reactions that occur explosion-like, it is also possible for slowly going on oxidation processes to take place. This degradation of the pyrotechnical material is reliably prevented by the passivation, thus prolonging the service life of the explosive composition.

The oxidizer preferably consists entirely or partially of compounds that have been selected from the group of alkali metal nitrates and alkali metal perchlorates, earth alkali metal nitrates and earth alkali metal perchlorates, ammonium nitrate, ammonium perchlorate and mixtures thereof. Especially preferably, the oxidizer is an alkali metal nitrate such as lithium nitrate, sodium nitrate and potassium nitrate, an earth alkali metal nitrate such as strontium nitrate, or an alkali metal perchlorate such as lithium perchlorate, sodium perchlorate and potassium perchlorate. These compounds are readily available and are compositions with a long storage life. Preferably, the fraction of these compounds in the oxidizer is at least 70% by weight. Advantageously, those compounds are used that have a sufficient solubility in organic solvents such as alcohols, ethers and ketones and/or melt without decomposition.

The oxidizer and the fuel can be present in an approximately stoichiometric ratio. However, depending on the application purpose, the oxidizer can also be overbalanced or underbalanced in relation to the fuel.

Examples of an oxidizer from the group of organic nitro compounds are dinitromethane, trinitromethane, tetranitromethane, dinitrofurazan, nitroglycerin or 2,2,2-trinitroethanol. Possible organic nitrates are compounds that have an oxygen balance of more than −30%, preferably more than −20% and particularly preferably greater than 0%. Particularly suitable nitrates are glycerin trinitrate, 1,2,3,4-butane tetroltetranitrate, aminotetrazolnitrate, pentaerythritol tetranitrate and ethylene diamine dinitrate. The term "oxygen balance" refers to the amount of oxygen (in percent by weight) that is released ($O_2$ overbalancing) or that is lacking ($O_2$ underbalancing) when a compound is completely reacted to form $CO_2$, $H_2O$, etc. The deficit is indicated by a negative sign.

The oxidizer is preferably incorporated into the porous fuel by applying the oxidizer as a liquid or in solution, the liquid or the solution being retained in the pores by capillary forces. Subsequently, the solvent can be evaporated so that the oxidizer remains in the pores in solid form. Preferred solvents are water, alcohols, ethers, ketones or mixtures thereof. Moreover, the oxidizer can also be incorporated by application as a melt with subsequent solidification in the pores or else by electrochemical deposition processes. Moreover, the oxidizer can also be incorporated by chemical vapor deposition (CVC, MOCVD) or physical vapor deposition (PVD).

The composition according to the invention has the advantage that no evaporation of the fuel and/or oxidizer is necessary for the combustion, since the reactants are already homogeneously mixed with each other on an atomic or molecular level. Thus, an excellent homogeneity of the pyrotechnical charge or of the explosive material is achieved. The pyrotechnical properties of the composition can be specifically adjusted by means of the porosity of the fuel and a possible passivation, so that they can be optimally adjusted to the respective application purpose.

The composition according to the invention also has a high structural strength since the fuel is present in the form of a solid, shape-imparting matrix. The composition can thus be used as a load-bearing component in pyrotechnical devices, e.g. igniters. Moreover, in case of the use of porous silicon as the fuel, the production processes known from semiconductor technology and micromechanics can be employed. This provides the possibility of less expensive production using standard components. In particular, the composition according to the invention can be completely integrated into semiconductor circuits.

Hence, the subject matter of the invention is also the use of the composition according to the invention as a detonating agent or as a component of an igniter. This igniter can advantageously be integrated into a semiconductor circuit. In particular, the igniter can be part of a safety system in vehicles such as, for example, a gas generator for a belt tensioner or an airbag module.

Furthermore, it is conceivable to use the explosive composition according to the invention as a component of a micromechanical drive. This micromechanical drive can advantageously be integrated into a semiconductor circuit.

Further features and advantages will be apparent from the following description of preferred embodiments.

DETAILED DESCRIPTION OF THE PREFERRED EMBODIMENTS

EXAMPLE 1

For the production of an explosive composition according to the invention, first of all, porous, nanostructured silicon is prepared. Fundamentally, this material can be technically produced by means of a wide variety of technologies. These include processes that are based on the deposition of the silicon from the gas phase such as, for instance, MOCVD, MBE, CVD, PVD or sputtering. These processes, however, are complex and cost-intensive and consequently less preferred.

According to the invention, the porous silicon is prepared here by means of electrochemical etching using the process described in Materials Science and Engineering B 69–70 (2000) 11–22 or Phys. Rev. Lett. (2001), 87, 68 301 ff. For this purpose, a silicon substrate is connected in an etching cell as the anode and treated in an electrolyte containing hydrogen fluoride, for example, a mixture of equal volume fractions of ethanol and concentrated aqueous hydrofluoric acid (50 percent) at an anodization current ranging from 20 to 70 mA/cm$^2$. In this case, the silicon substrate is p-doped, but it can also be n-doped or undoped. The volume ratio of HF and ethanol can be varied, preferably in the range between 3:1 and 1:3. The porosity of the silicon thus obtained was in the range from 40% to 80%. The structure size varied between 2 nm and 10 nm. Thereafter, the porous silicon substrate was tempered in air for 30 seconds at about 700° C. to passivate the surface of the porous silicon.

The porous silicon thus obtained was impregnated with a potassium nitrate solution and subsequently dried in air. An electric spark was able to trigger a strong explosion. Theoretical calculations yielded an energy release in the range of 28 kJ/g for this explosion. The calculated combustion temperatures were in the range between 2900 K and 4100 K.

EXAMPLE 2

A silicon monocrystal wafer with a resistivity of 10–20 mOhm cm, doped with boron and having a (100) crystal lattice, was electrochemically etched in a solution of 25% HF, 50% ethanol and 25% water. Porous silicon with a pore size of 10–20 nm and a porosity of 60% was produced at a current density of 100 A/cm$^2$, with the substrate connected to plus potential. The sample was passivated by tempering in air for 30 seconds at 400° C., so that about one monolayer of $SiO_2$ was formed on the surface of the porous silicone. Then $LiClO_4$ as the oxidizer was incorporated into the pores by adding a saturated solution of $LiClO_4$ in methanol to the surface of the porous silicone. Due to the high capillary forces in the pores, this solution was aspirated by the porous silicone. Thereafter, the sample was dried for about 10 minutes at room temperature; in this process, small amounts of $LiClO_4$ form a precipitate on the surface of the porous material. The sample treated in this way was then heated to about 270° C. In so doing, $LiClO_4$ present on the surface melts and likewise enters into the pores due to the capillary forces. At the same time, the long-term stability of the sample is substantially improved by the second heat treatment in the presence of $LiClO_4$. Samples prepared in this way can be brought to a spontaneous reaction, with loud detonation, for instance by quick heating up with a heating plate or by an energized thin film resistor attached to the surface of the sample. On the other hand, however, the samples have a very low susceptibility to shock and friction.

Further suitable explosive compositions are shown in the following table. Preferably, these compositions contain about 20% to 50% by weight of porous silicon and approximately 50% to 80% by weight of an alkali metal nitrate as the oxidizing agent.

| | Formulation 1 | Formulation 2 | Formulation 3 | Formulation 4 | Formulation 5 | Formulation 6 |
|---|---|---|---|---|---|---|
| $LiNO_3$ | | | | | 65% | 56% |
| $NaNO_3$ | | | 71% | 61% | | |
| $KNO_3$ | 74% | 64% | | | | |

-continued

| | Formulation 1 | Formulation 2 | Formulation 3 | Formulation 4 | Formulation 5 | Formulation 6 |
|---|---|---|---|---|---|---|
| Si | 26% | 36% | 30% | 40% | 36% | 44% |
| Oxygen Balance | balanced | underbalanced | balanced | underbalanced | underbalanced | underbalanced |
| Calculated Temperature (K) | 4053 | 2991 | 4086 | 3262 | 3958 | 3561 |
| Si Excess (%) | 0% | 10% | 0% | 10% | 1.5% | 10% |

The results show that the system consisting of porous silicon/potassium nitrate is suitable for use as an explosive material. The porosity of the porous silicon can be used to regulate the strength of the explosion since the pore volume determines the amount of oxidizing agent incorporated and thus the stoichiometry of the reactants. The porosity, which can be easily regulated by the current density or by the fluoride concentration during the etching, allows an optimization of the explosive force with simple means. At the same time, the ratio of fuel to oxidizing agent thus defined can cover the entire range of the oxidation reaction from the combustion and the deflagration to the explosion with just one composition. The oxidation, in contrast to the system consisting of porous silicon/liquid oxygen, does not take place spontaneously but rather can be triggered specifically, for example, by a current pulse.

Through the use of porous silicon as the starting material, the explosive composition on the basis of porous silicon, together with the control electronics, can be compactly integrated on a chip. Thus, the explosive composition according to the invention can be used as a detonating agent or as an igniter integrated into a semiconductor circuit. This allows a miniaturization of prior art systems the operating principle of which is based on an explosion. The igniter thus produced can be used in a safety system for vehicles, for example, in an airbag module or in a belt tensioner.

Furthermore, patterns can be created in other materials with layers of the explosive composition according to the invention and based on porous silicon. The layers can be made with a lateral extension of several hundred micrometers, the layer thickness lying in the range of several micrometers. During the explosion, the resultant two-dimensional geometry brings about a directed pressure wave that is propagated perpendicular to the layer. In this manner, spatial areas are systematically deformed and patterns are created which, however, do not affect adjacent regions. Thus, in conjunction with the mask technology of microelectronics, all kinds of geometries of the explosive composition based on porous silicon and thus all kinds of pressure wave profiles can be produced. Small amounts of the explosive composition allow a structuring in the micrometer range.

What is claimed is:

1. An explosive composition comprising a porous fuel and an oxidizer, wherein said porous fuel is a solid having a structure size measuring between about 2 nm and 1000 nm, and having pores with a pore size ranging between 2 nm and 1000 nm, the fuel having a porosity that varies between 10% and 98%, wherein said oxidizer, having one of a solid and liquid state at room temperature, is incorporated into said pores of said porous fuel, and is selected, in an amount of at least 50% by weight relative to a total quantity of said oxidizer, from the group consisting of hydrogen peroxide, hydroxyl ammonium nitrate, organic nitro compounds or nitrates, alkali metal nitrates or earth alkali metal nitrates as well as metal nitrites, metal chlorates, metal perchlorates, metal bromates, metal iodates, metal oxides, metal peroxides, ammonium perchlorate, ammonium nitrate and mixtures thereof, and wherein said fuel is at least partially passivated to increase an activation energy for reacting said fuel with said oxidizer.

2. The composition according to claim 1, wherein said fuel has a structure size measuring between 2 nm and 50 nm.

3. The composition according to claim 1, wherein said fuel has an inner specific surface area of up to 1000 $m^2/cm^3$.

4. The composition according to claim 1, wherein said fuel is selected from the group consisting of Si, Ge, SiGe, SiC, InP, GaAs, C, Be, Mg, Al, Ti and metal hydrides as well as combinations and compounds thereof.

5. The composition according to claim 1, wherein said fuel is a semiconductive material, in particular porous silicon.

6. The composition according to claim 1, wherein said fuel is passivated by tempering in air.

7. The composition according to claim 1, wherein between 50% and 100% by weight of said oxidizer consists of a compound that is selected from the group consisting of alkali metal nitrates and alkali metal perchlorates, earth alkali metal nitrates and earth alkali metal perchlorates, ammonium nitrate, ammonium perchlorate and mixtures thereof.

8. The composition according to claim 7, wherein said oxidizer is one of an alkali metal nitrate and earth alkali metal nitrate.

9. The composition according to claim 1, wherein said .fuel has an anisotropic porosity.

10. The composition according to claim 1, wherein said oxidizer and said fuel are present in an approximately stoichiometric ratio.

11. The composition according to claim 1, wherein said oxidizer is overbalanced in relation to said fuel.

12. The composition according to claim 1, wherein said oxidizer is underbalanced in relation to said fuel.

13. A method of producing an explosive composition comprising a porous fuel and an oxidizer, wherein said porous fuel is a solid having a structure size measuring between about 2 nm and 1000 nm and pores with a pore size ranging between 2 nm and 1000 nm, and having a porosity that lies between 10% and 98%, wherein said oxidizer, having one of a solid and liquid state at room temperature, is incorporated into said pores of said porous fuel, and being selected, in an amount of at least 50% by weight relative to a total quantity of said oxidizer, from the group consisting of hydrogen peroxide, hydroxyl ammonium nitrate, organic nitro compounds or nitrates, alkali metal nitrates or earth alkali metal nitrates as well as metal nitrites, metal chlorates, metal perchlorates, metal bromates, metal iodates, metal oxides, metal peroxides, ammonium perchlorate, ammonium nitrate and mixtures thereof, the method comprising the following steps:

preparing said porous fuel by one of electrochemical etching and physical or chemical deposition processes;

providing the porous fuel with a passivation layer to increase an activation energy for reacting the fuel and the oxidizer, and introducing said oxidizer into said pores of said fuel by electrochemical deposition, physical and chemical vapor deposition or by applying said oxidizer as a liquid or dissolved in a solvent and preferably, evaporating said solvent.

14. The method according to claim 13, wherein said fuel is porous silicon produced by electrochemical etching in an electrolyte containing hydrofluoric acid.

15. The method according to claim 14, wherein said porous silicon is tempered in air.

16. The method according to claim 15, wherein said tempering is carried out at a temperature between 150° C. and 300° C. with formation of an oxygen submonolayer.

17. The method according to claim 15, wherein said tempering is carried out at a temperature of more than 300° C. with formation of a SiC passivation layer.

18. A device including a detonating agent comprising an explosive composition according to claim 1.

19. An igniter incorporating an explosive composition according to claim 1.

20. The igniter according to claim 19, said igniter being integrated into a semiconductor circuit.

21. The igniter according to claim 20, said igniter being a component of a safety system in motor vehicles.

22. A micromechanical drive incorporating an explosive composition according to claim 1.

23. The micromechanical drive according to claim 22, said micromechanical drive being integrated into a semiconductor circuit.

* * * * *

UNITED STATES PATENT AND TRADEMARK OFFICE

CERTIFICATE OF CORRECTION

PATENT NO. : 6,984,274 B2
DATED : January 10, 2006
INVENTOR(S) : Achim Hofmann et al.

It is certified that error appears in the above-identified patent and that said Letters Patent is hereby corrected as shown below:

Column 9,
Line 16, before "passivation" chage "SiC" to -- Si-O --.

Signed and Sealed this

Twenty-third Day of May, 2006

JON W. DUDAS
*Director of the United States Patent and Trademark Office*